US009780425B2

(12) United States Patent
Liu et al.

(10) Patent No.: US 9,780,425 B2
(45) Date of Patent: Oct. 3, 2017

(54) MICROWAVE COMPONENT OF CAVITY TYPE

(71) Applicant: Comba Telecom Technology (Guangzhou) Ltd., Guangdong Province (CN)

(72) Inventors: Peitao Liu, Guangdong Province (CN); Guosheng Su, Guangdong Province (CN); Fengzhang Xue, Guangdong Province (CN); Litao Chen, Guangdong Province (CN); Binlong Bu, Guangdong Province (CN)

(73) Assignees: COMBA TELECOM SYSTEMS (CHINA) LTD., Science, Guangzhou (CN); COMBA TELECOM TECHNOLOGY (GUANGZHOU) LTD., Guangzhou (CN); COMBA TELECOM SYSTEMS (GUANGZHOU) LTD., Guangzhou (CN); TIANJIN COMBA TELECOM SYSTEMS LTD., Tianjin (CN)

( * ) Notice: Subject to any disclaimer, the term of this patent is extended or adjusted under 35 U.S.C. 154(b) by 0 days.

(21) Appl. No.: 15/114,233

(22) PCT Filed: Jan. 27, 2015

(86) PCT No.: PCT/CN2015/071662

§ 371 (c)(1),
(2) Date: Jul. 26, 2016

(87) PCT Pub. No.: WO2015/113940

PCT Pub. Date: Aug. 6, 2015

(65) Prior Publication Data

US 2017/0012336 A1 Jan. 12, 2017

(30) Foreign Application Priority Data

Jan. 28, 2014 (CN) ..... 2014 1 0042992

(51) Int. Cl.
*H01P 5/00* (2006.01)
*H01P 1/18* (2006.01)
(Continued)

(52) U.S. Cl.
CPC ..... *H01P 1/182* (2013.01); *H01P 1/207* (2013.01); *H01P 5/182* (2013.01); *H01Q 3/30* (2013.01); *H01Q 3/32* (2013.01)

(58) Field of Classification Search
CPC ..... H01P 1/182; H01P 1/183; H01P 1/207; H01P 5/182
(Continued)

(56) References Cited

U.S. PATENT DOCUMENTS 6,400,235 B1 * 6/2002 Perez ..... H01P 5/183 333/113
7,429,903 B2 * 9/2008 Antkowiak ..... H01P 5/183 333/109
(Continued)

FOREIGN PATENT DOCUMENTS

CN 102176524 A 9/2001
CN 101699647 4/2010
(Continued)

OTHER PUBLICATIONS

CN Application No. 201410225678.X, Filing Date: May 26, 2014.
CN Application No. 201410225678.X—Notification of First Office Action (with English translation attached), dated Oct. 20, 2015.
CN Application No. 201410225678.X—Notification of Second Office Action (with English translation attached), dated Mar. 16, 2016.
(Continued)

*Primary Examiner* — Dean Takaoka
(74) *Attorney, Agent, or Firm* — Verrill Dana, LLP

(57) ABSTRACT

A microwave component of cavity type includes an integral cavity and a microwave network circuit disposed in the cavity. The cavity has multiple enclosing walls and a chamber defined by said multiple enclosing walls. The chamber is intended for accommodating the microwave network circuit therein. A wiring slot is defined in at least one of the enclosing walls, and at least one first through hole extended through the chamber is provided on each wiring slot. The microwave component of cavity type features small size, simple structure, and wide application. Furthermore, cost may be reduced, batch production may be achieved, use of fasteners such as screws is avoided, and the passive intermodulation products caused by fasteners are eliminated, as the microwave component is secured without any screws.

12 Claims, 5 Drawing Sheets

(51) Int. Cl.

| | |
|---|---|
| ***H01Q 3/32*** | (2006.01) |
| ***H01Q 3/30*** | (2006.01) |
| ***H01P 1/207*** | (2006.01) |
| ***H01P 5/18*** | (2006.01) |
| *H01P 3/06* | (2006.01) |

(58) Field of Classification Search
USPC ..... 333/24 R, 160
See application file for complete search history.

(56) References Cited

U.S. PATENT DOCUMENTS

| | | | | |
|---|---|---|---|---|
| 2005/0264379 | A1 | 12/2005 | Obata | |
| 2016/0286643 | A1* | 9/2016 | Taguchi | H01P 5/107 |
| 2016/0372809 | A1* | 12/2016 | Liu | H01P 1/182 |
| 2017/0069941 | A1* | 3/2017 | Liu | H01P 1/18 |

FOREIGN PATENT DOCUMENTS

| | | | |
|---|---|---|---|
| CN | 101699647 | A | 4/2010 |
| CN | 201804989 | U | 4/2011 |
| CN | 202495561 | | 10/2012 |
| CN | 202495561 | U | 10/2012 |
| CN | 203288724 | U | 11/2013 |
| CN | 104037475 | | 9/2014 |

OTHER PUBLICATIONS

CN Application No. 201410225678.X—Notification of Third Office Action (with English translation attached), dated Jun. 24, 2016.
CN Application No. 201410225678.X—Notification of Decision of Granting Patent Rights (with English translation attached), dated Jan. 10, 2017.

* cited by examiner

A-A

MICROWAVE COMPONENT OF CAVITY TYPE

CROSS-REFERENCE TO RELATED APPLICATIONS

This application is the US National Stage of International Application No. PCT/CN2015/071662, filed on Jan. 27, 2015, which claims the priority of the Jan. 28, 2014 Chinese Application No. 201410042992.4. The contents of each of the above-referenced applications are incorporated herein by reference in its entirety.

FIELD OF THE INVENTION

The present invention relates to field of microwave communication and more particularly, to a microwave component.

BACKGROUND OF THE INVENTION

Microwave components are necessary in mobile communication network coverage. At present commonly used microwave components mainly include phase shifters, power dividers, filters, couplers, diplexers, and the like. The quality of these components will have effect on quality of the entire network coverage. Accordingly, the microwave components play a very important role in technical field of mobile communication.

A prior art microwave component is mainly composed of a microwave network circuit, a cavity, and a cover. During assembling process, some structural elements function to secure the microwave network circuit onto the cavity. Next, the cavity and cover are mounted together by means of screws. Moreover, to facilitate welding of a transmission cable, a number of structurally complicated wiring slots are provided on the cavity.

The following problems exist however, during design and use of the microwave components:

At first, to avoid resonance of the microwave components, a great number of screws are used to secure the cavity and cover together, thereby lowering production efficiency.

Secondly, use of many screws in the microwave component for fastening purpose will possibly cause failure. For example, inter-modulation products perhaps will be generated if interconnection among the components is bad.

Thirdly, to install wiring slots for assisting the welding of the transmission cable, the cavity is usually designed by manner of "metal die-casting plus cover". Alternatively, it is designed by manner of "semi-open extruded cavity plus cover plus independently welded head", or "extruded cavity plus independently welded head". Externally disposed cover or externally disposed welded head both require a large number of screws for fastening purpose. This increases not only possibility of electrical failure, but also size, weight and cost.

SUMMARY OF THE INVENTION

A major object of the invention is to provide a microwave component of cavity type, which can reduce size of the microwave component, avoid connection with screws, and makes optimization to current microwave component in terms of electrical performance, physical features and assembly processes.

To achieve the above objects, one technical solution employed by the present invention is as follows:

A microwave component of cavity type includes an integral cavity and a microwave network circuit disposed in the cavity. The cavity has multiple enclosing walls and a chamber defined by said multiple enclosing walls. The chamber is intended for accommodating the microwave network circuit therein. A wiring slot is defined in at least one of the enclosing walls, and at least one first through hole extended through the chamber is provided on each wiring slot.

The cavity is formed by extrusion or die-casting process.

An axis of the first through hole is inclined with respect to a longitudinal direction of the microwave component.

Preferably, the above inclination occurs with an angle of 30° to 150°.

Each enclosing wall, on which no wiring slot is provided, of the cavity, is provided with an operation hole corresponding to a respective first through hole.

A number of wiring slots are defined in a same enclosing wall in a layered or segmented manner; and each wiring slot is provided with said first through hole for arranging a transmission cable along a respective wiring slot and permitting the transmission cable passing through the first through hole to connect with the microwave network circuit so as to form a connection port.

Two opposite or adjacent enclosing walls are provided with the wiring slots respectively; and each wiring slot is provided with said first through hole for arranging a transmission cable along a respective wiring slot and permitting the transmission cable passing through the first through hole to connect with the microwave network circuit so as to form a connection port.

The wiring slot is connected and secured with an outer conductor of the transmission cable by solder; and an inner conductor of the transmission cable is allowed to pass through the first through hole and extend into the cavity to connect with the microwave network circuit.

At least one of two end surfaces along the longitudinal direction of the microwave network circuit is not provided with enclosing walls such that an opening is predefined therein through which the microwave network circuit is able to connect to an external operation element.

A holding groove is defined in each of a pair of opposed enclosing walls of the cavity along a longitudinal direction for holding a base plate of the microwave network circuit in place.

An embossment is provided in an inner wall of each of a pair of opposite enclosing walls of the cavity along a longitudinal direction for separating the cavity.

The base plate of the microwave network circuit is provided with a metal welding piece at two sides thereof and said metal welding piece is welded inside the cavity.

The microwave network circuit is supported inside the cavity by an insulated structural component.

The microwave network circuit is a phase shifting circuit, filter circuit, power divider circuit, coupler circuit, diplexer circuit, or combiner circuit.

The present invention has the following advantageous effects when compared to prior art:

At first, the cavity of the microwave component of cavity type according to the present invention is produced integrally. The microwave network circuit is secured into the cavity of the microwave component. In addition, the microwave network circuit may be welded together with the inner conductor of the transmission cable. As a result, the fastening of the microwave component may be achieved without any metal screws, thus facilitating assembly and batch production. Also, the passive inter-modulation products caused by fasteners such as screws are eliminated.

Secondly, the microwave component of cavity type according to the present invention has small size, light weight, and low cost.

Finally, the microwave component of cavity type according to the present invention has a simple construction and may be made by various forming processes such as extrusion and die-casting, thus enabling batch production.

DETAILED DESCRIPTION OF THE INVENTION

Figure 1:
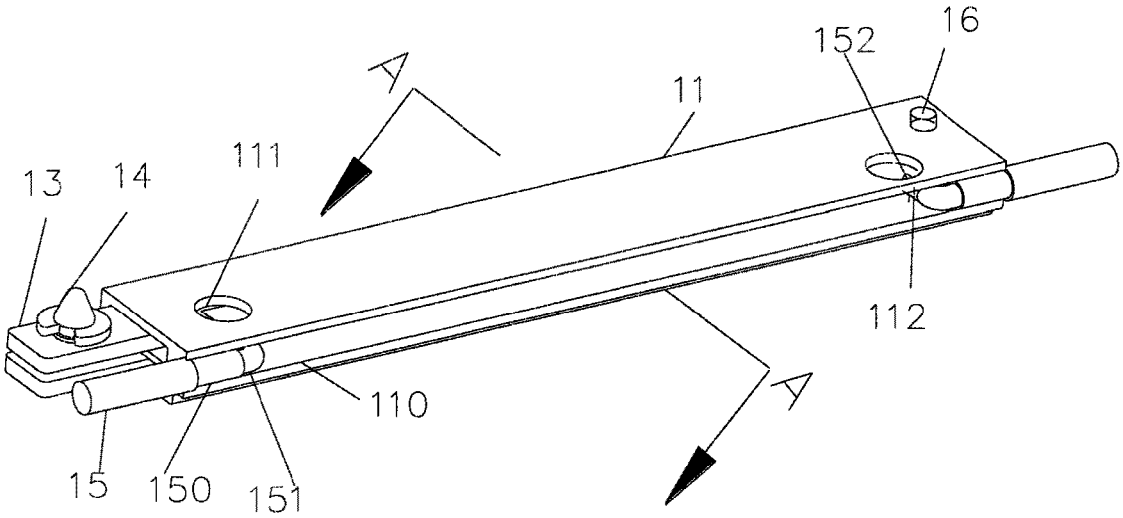
FIG. 1 shows a perspective view of a phase shifter of a first embodiment according to the present invention.

The present invention will be described in detail below with reference to the accompanying drawings and various embodiments. Detailed description of techniques unnecessary for illustration of features of present invention will be omitted herefrom.

The microwave component as used herein may include phase shifters, couplers, filters, diplexers, combiners or power dividers. Correspondingly, the microwave network circuits may include a phase shifter circuit, coupler circuit, filter circuit, diplexer circuit, combiner circuit or power divider circuit. Implementation of above kinds of microwave components of cavity type and their variations are all known by person of the art. As person of the art know these solid structure, micro-strip structure or printed structure and accordingly, description of them is omitted herefrom.

The microwave component of cavity type of the present invention includes a cavity and a microwave network circuit disposed inside the cavity.

The cavity is integrally formed by extrusion or die-casting. The cavity is of an oblong shape and includes multiple enclosing walls and a chamber defined by the enclosing walls for receiving the microwave network circuit and other related components therein.

Dependent upon requirement of operation of person of the art, the cavity may be designed to include four enclosing walls longitudinally disposed and surrounding the cavity. In other words, two end surfaces along the longitudinal direction are not provided with enclosing walls such that an opening is predefined. Alternatively, the cavity may also be designed to contain five enclosing walls with above four walls longitudinally disposed and surrounding the cavity included. In other words, one of the two end surfaces along the longitudinal direction is not provided with an enclosing wall in order to define an opening through which an external operation element may come and perform operation. For example, an external force actuation device may be disposed in the opening of a phase shifter to manipulate a dielectric element for achieving phase shifting. Or, an adjusting screw may be provided in the opening to tune a filter or the like, thus achieving related adjustment to the microwave network circuit.

A wiring slot is defined in one or more enclosing walls of the cavity. The wiring slot is interconnected and secured with an outer conductor of a cable by solder. Several wiring slots may be defined in a same enclosing wall. These wiring slots may be formed in the same enclosing wall in a layered or segmented manner. The layered manner means that the several wiring slots are extended along the longitudinal direction of the same enclosing wall and are substantially parallel with each other so as to form layered configuration. The segmented manner means that the several wiring slots are discontinuously disposed on the longitudinal direction of the same enclosing wall. For example two wiring slots may be defined at two sides of one enclosing wall. Of course, these wiring slots may also be defined at two opposite or adjacent enclosing walls respectively dependent upon configuration of connection ports of an internal microwave network circuit. Similarly, the layered or segmented manner may apply when several wiring slots are defined in one enclosing wall.

Each wiring slot has a first through hole extended through the chamber of the cavity so that a transmission cable may be arranged in a corresponding wiring slot, come across the first through hole, and then is connected with the microwave network circuit, thus forming a connection port of the same circuit.

Furthermore, to facilitate wiring of an antenna, the axis of the first through hole is inclined relative to the longitudinal direction of the microwave component. This inclination angle as used herein may be flexibly selected by person of the art according to requirement of wiring. Preferably this inclination angle ranges from 30° to 150°. This range of angle is better suitable for wiring of the transmission cable.

Moreover, the enclosing walls such as those shown in top portion in FIG. 1, on which no wiring slots are formed, of the cavity, are provided with operation holes corresponding to the first through holes respectively for achieving connection between the transmission cable and microwave network circuit, or achieving the adjustment and maintenance of the microwave component. As used herein, depending upon requirement of operation, person of the art would be able to flexibly select enclosing walls for defining operation holes therein. In addition, shape and size of the operation holes may also be designed with flexibility by person of the art.

The microwave network circuit may be a printed circuit based on a base plate such as PCB or a circuit constructed of metal conductor with solid structure. In case that the microwave network circuit is implemented by PCB, a microwave network circuit for realizing known specific circuit function may be printed on the PCB. To fix the PCB inside the chamber of the cavity, a holding groove may be defined in each of a pair of opposed enclosing walls of the cavity for holding the base plate in place. Alternatively, the base plate may be provided with a metal welding piece at two sides thereof. The base plate may be welded onto the enclosing walls (or any other suitable locations) located at two longitudinal ends of the cavity, thus supporting the base plate into the cavity. In case the microwave network circuit is made of metal conductor, the same circuit may be supported into the chamber through an insulated structural component.

First Embodiment

Referring to FIG. 1, a microwave component of cavity type of the present invention is embodied as a phase shifter 1. The phase shifter 1 includes a cavity 11, a phase shifting circuit 12 disposed inside the cavity, a dielectric element 13 located between the cavity 11 and phase shifting circuit 12, and an external force actuation element 14 disposed on the dielectric element 13. To better explain structure and principles of the present invention, the present invention further discloses a transmission cable 15 assembled together with the phase shifter 1. Other embodiments may also be illustrated using this transmission cable.

Figure 2:
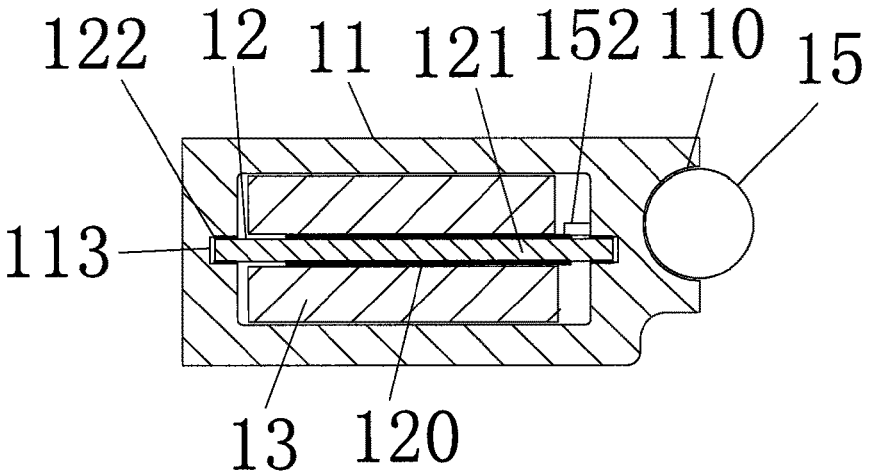
FIG. 2 shows a cross-sectional view of the phase shifter in FIG. 1 along line A-A.

Reference is made to FIGS. 1 and 2. The cavity 11 is formed by extrusion or die-casting process. The cavity 11 has four enclosing walls (no labeled). Two end surfaces of the cavity 11 along its longitudinal direction are not provided with any enclosing walls so as to define an opening therein. A chamber (not labeled) is defined inside the cavity 11. One or more wiring slots 110 are provided on an outer side of at least one enclosing wall of the cavity 11 for welding an outer conductor 150 of a transmission cable 15 therein. Dependent upon requirement of a leading wire of microwave network circuit, a plurality of first through holes 112 are defined in the wiring slot 110 and extend through two sidewalls of the cavity. The first through hole 112 serves to receive an inner conductor 152 of the transmission cable 15 therein such that the conductor 152 will be electrically coupled with the phase shifting circuit 12. As the cavity 11 is made of metal, the inner diameter of the first through hole 112 must be such designed that a dielectric body 151 of the transmission cable 15 is allowed to pass through the hole 112. By this manner, the cavity 11 of the phase shifter 1 is insulated from the inner conductor 152 of the transmission cable 15. To facilitate arrangement of antenna, an axis of the first through hole 112 is angled relative to the longitudinal direction of the phase shifter 1. As such, this through hole 112 is inclined with respect to the thickness direction of an enclosing wall in which the same hole 112 is defined. This angle may be determined with flexibility by person of the art based on welding direction of the transmission cable 15. Preferably, the angle ranges from 30° to 150° for facilitating layout of the transmission cable.

Corresponding to the first through hole 112, an operation hole 111 is defined in an enclosing wall located at the top of the cavity 11 so that the inner conductor 152 of the transmission cable 15 will be readily electrically connected with an input port 123 of the phase shifting circuit 12. Preferably, the inner conductor 152 is welded together with the input port or output port of the phase shifting circuit 12. Moreover, it is known to person of the art that connection of the inner conductor 152 of the transmission cable 15 with the input port or output port is not limited by welding. For example, the input port or output port may be configured in such manner that the inner conductor is able to insert into the port, thus avoiding forming an operation hole 111 in the enclosing wall. It should be understood that the operation hole 111 may be selected flexibly by person of the art according to requirement of wiring arrangement or the like. In fact, this operation hole may be formed in any enclosing wall on which no wiring slot is defined.

Referring to FIG. 2, each of two opposite enclosing walls inside the cavity 11 is provided with a holding groove 113 at an inner surface thereof for holding the base plate 121 of the phase shifting circuit 12 in place.

In this embodiment, the phase shifting circuit 12 is a circuit printed on a base plate such as a PCB. Here, 121 represents the base plate of a double-side printed PCB, while 120 represents a phase shifting circuit unit printed on the base plate 121. An upper layer of circuit and a lower layer of circuit are coupled together by several apertures. In addition, a locating hole (not shown) is also defined in the base plate. To prevent location change of the base plate 121 during operation, the base plate 121 with the phase shifting circuit printed thereon is inserted into the holding groove 113 of the cavity 11. Furthermore, a metal welding piece 122 is disposed on each of two opposite sides of the base plate. The metal welding piece 122 is welded in the holding groove 113 of the cavity. In addition, an insulated structural component 16 passes across the locating hole of the base plate 121 to support the same. Of course, the base plate may also be welded at other suitable location using the welding piece 122 so as to stabilize the base plate. In other embodiments, the base plate 121 may be a single layer of PCB. The phase shifting circuit 12 may also be a circuit constructed of metal conductor such as a metal bar following the principle of phase shifting circuit.

Please refer to FIGS. 1 and 2 together. As discussed above, the phase shifter 1 of present invention includes a dielectric element 13 disposed between the cavity 11 and phase shifting circuit 12. The dielectric element 13 is elongated and made of material with dielectric constant $\in_r > 1.0$. There may be one or more kinds of materials to make the element 13. In addition to high dielectric constant requirement, the material is further required to preferably have low loss angle tangent characteristics. To achieve good circuit performance, an impedance transformer may be formed by the phase shifter 1. The impedance transformer may be formed in one or more of the dielectric element 13, the inner wall of the cavity 11, and microwave network circuit 12.

When driven, the dielectric element 13 moves straight along the longitudinal direction, thereby changing signal transmission speed inside the phase shifter 1, further changing phase of the signal, producing phase difference, and finally realizing phase shifting.

External force is required to cause straight movement of the dielectric element 13. An old manner is applying external force onto one end of the element 13 manually, pushing and pulling the element 13 along the longitudinal direction relative to the cavity 11 and phase shifting circuit 12 so as to causing straight movement. To help pushing and pulling motion, the external force actuation device 14 may be disposed on the dielectric element 13 additionally and is located at an opened end of the cavity 11. As manually applying external force is not better, the external force actuation device 14 of the invention may further be combined with other component so as to form a phase shifting driving device, hence enabling electrical control of the phase shifter 1 of the invention. Alternatively, control of more flexibility than manual manner may be achieved.

It may be known to persons of the art that some features of this embodiment might be applied to other embodiments. For example, features regarding material and structure of moveable dielectric body may be employed in a second embodiment. The microwave network circuit may be constructed of metal conductor based on well-known principle of circuit, or circuit printed on a base plate based on PCB for realizing specific circuit function. In addition, manner by which the microwave network circuit is secured into the cavity may also be applied to various embodiments of the invention. Please note that in following embodiments, certain structure perhaps will not be described and it should not be understood that the microwave component of the invention lacks of this certain structure. Moreover, some structure in following embodiments may also be applied to present embodiment. In other words, the microwave component of cavity type of the present invention may be configured with flexibility by person of the art.

Second Embodiment

Figure 3:
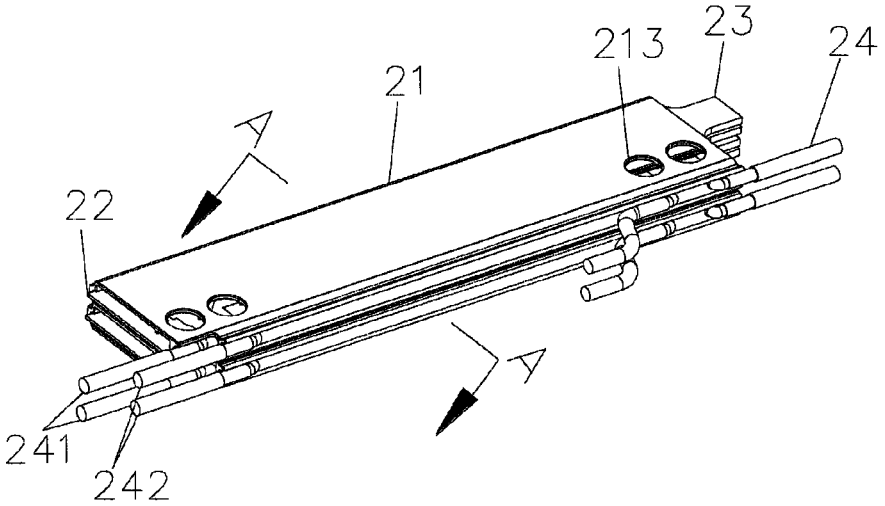
FIG. 3 shows a perspective view of a phase shifter with four ports of a second embodiment according to the present invention.
Figure 4:
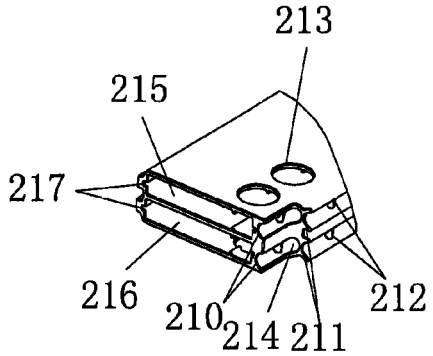
FIG. 4 shows a partial view of the phase shifter with four ports in FIG. 3.
Figure 5:
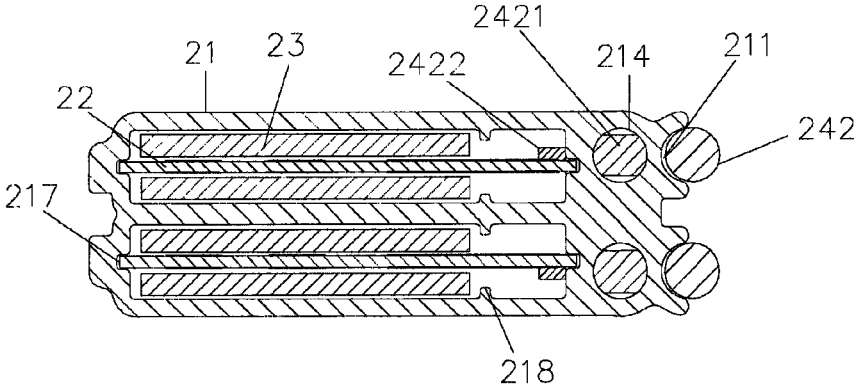
FIG. 5 shows a cross-sectional view of the phase shifter with four ports in FIG. 3 along line A-A.

Please refer to FIGS. 3-5. The microwave component of cavity type of the present invention is a phase shifter 2 with four ports. The shifter 2 includes a cavity 21, a phase shifting circuit 22 disposed inside the cavity 21, and a moveable dielectric element 23 placed between the cavity 21 and phase shifting circuit 22.

The cavity 21 is constructed by extrusion or die-casting process. The cavity 21 has an upper cavity 215 and a lower cavity 216 both of which run along a longitudinal direction of the cavity 21. A chamber (not labeled) is defined in each of the upper cavity and lower cavity. The same phase shifting circuits 22 may be located inside the chambers of the upper and lower cavities 215 and 216 respectively such that the phase shifter 2 with four ports may be suited for a single frequency dual polarized antenna. Different phase shifting circuits 22 may also be provided for the phase shifter 2 being suited for a multiple frequency antenna.

An enclosing wall (not labeled) of the cavity 21 is provided with a long hole 214 extending along the longitudinal direction of the cavity 21. To facilitate welding of a transmission cable 24, a first wiring slot 211 may be defined at an outer side of the long hole 214. Furthermore, a second wiring slot 210 may be constructed by removing part material from an outer side of the long hole 214. By this manner, the second wiring slot 210 may be used for welding a first transmission cable 241, while the first wiring slot 211 may be used for welding a second transmission cable 242, thus the first transmission cable 241 and second transmission cable 242 being disposed in a same enclosing wall in a layered manner.

Each of the first and second wiring slots 211, 210 is provided with a plurality of first through holes 212 which extending the entire side wall of the cavity. The inner conductor of the transmission cable 24 is able to pass through the first through holes 212 such that the inner conductor is capable of being electrically connected with the phase shifting circuit 22. As the cavity 21 is made of metal, the inner diameter of the first through hole must be such designed that a dielectric body of the transmission cable 24 is allowed to pass through the hole. By this manner, the cavity 21 of the phase shifter 2 is insulated from the inner conductor of the cable 24. To facilitate arrangement of antenna, an axis of the first through hole 212 is angled relative to the longitudinal direction of the phase shifter 2. This angle may be determined with flexibility by person of the art based on welding direction of the transmission cable 24. Preferably, the angle ranges from 30° to 150° for facilitating layout of the transmission cable.

Corresponding to the through hole 212, an operation hole 213 is defined in an upper enclosing wall of the upper cavity 215 and a lower enclosing wall of the lower cavity 216 so that the inner conductor of the cable 24 will be readily electrically connected with an input or output port of the phase shifting circuit 22.

A holding groove 217 is formed in each of a pair of opposite enclosing walls inside the cavity 21 for holding the phase shifting circuit 22 in place respectively. The phase shifting circuit 22 is a double-sided printed circuit with the function of phase shifting. During assembly, the base plate, on which the phase shifting circuit 22 is carried, is inserted into the holding groove 217 of the cavity 21 and is supported by an insulated structural component.

In other embodiments, to help arrangement of the antenna, a blind hole of certain depth may be defined in two longitudinal ends of a same enclosing wall of the cavity. Alternatively, wiring slots may be provided in opposite or adjacent enclosing walls of the cavity in place of a long hole 214 extending through the two ends. Consequently, person of the art would be able to determine the number and locations of the long holes or blind holes based on number of the ports of the microwave component. In other words, dependent upon requirement, a plurality of wiring slots may be formed in different ends of the same enclosing wall or the same or different end of different enclosing wall. In addition, they may also be disposed in a layered manner.

As discussed above, the phase shifter 1 with four ports further includes a moveable dielectric element 23 disposed between the cavity 21 and phase shifting circuit 22. An embossment 218 is provided in an inner wall of each of a pair of opposite enclosing walls of the cavity 21 along the longitudinal direction for separating the cavity. The embossments 218 divide the chamber into two parts, one is for cable welding, and the other is for receiving the moveable dielectric element 23. By location limiting action of the embossments 218, the moveable dielectric element 23 is able to move straight along the embossments 218. Moreover, this movement will not be influenced by connection location between the inner conductor of the cable 24 and phase shifting circuit 22. The moveable dielectric element 23 moves straight along the longitudinal direction when subject to force, thus changing signal transmission speed of the phase shifter 2. This causes phase change of the signal and generation of phase difference, thereby realizing phase shifting purpose.

Furthermore, multiple sub-cavities may be formed inside the cavity 21 by means of kinds of arrangements such as left-right arrangement or up-down arrangement. Different phase shifting circuit will run at a different working frequency and therefore it is suitable for a multiple frequency antenna. Person of the art would know that under this principle a phase shifter having multiple ports and multiple phase shifting components might be constructed. No matter how many phase shifting elements are included in the phase shifting component and how many ports are included in each phase shifting element, the cavity 21 is of an integral configuration.

Third Embodiment

Figure 6:
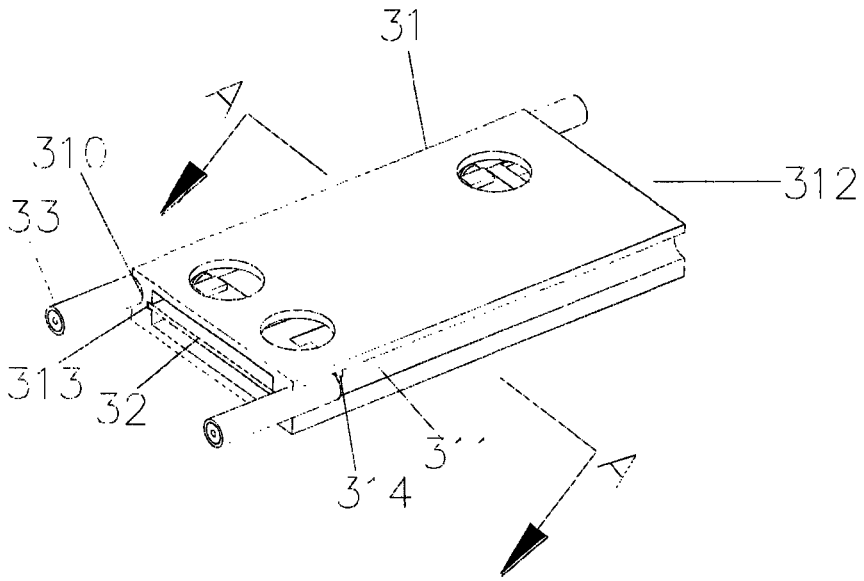
FIG. 6 shows a perspective view of a directional coupler of a third embodiment according to the present invention.
Figure 7:
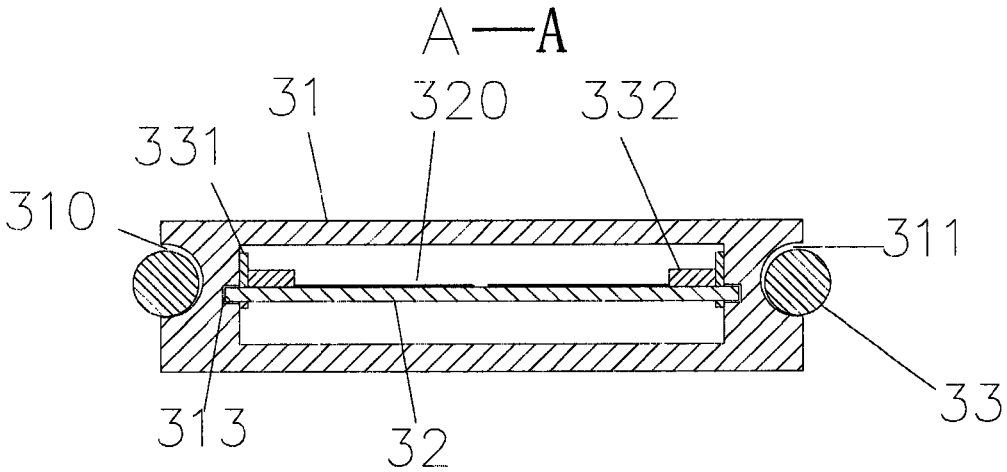
FIG. 7 shows a cross-sectional view of the directional coupler in FIG. 6 along line A-A.

Reference is made to FIGS. 6-7. The microwave component of cavity type of the present invention is a directional coupler 3 including a cavity 31, a coupler circuit 32, and a transmission cable 33.

The cavity 31 is integrally formed by extrusion or die-casting. A chamber (not labeled) is defined inside the cavity 31 and extends along the longitudinal direction of the cavity 31. Two enclosing walls of the cavity 31 are provided with a first wiring slot 310 and a second wiring slot 311 respectively for welding the transmission cable 33. A number of first though holes 314, which extend across the enclosing walls of the cavity, are defined in each of the first wiring slot 310 and second wiring slot 311. An inner conductor of the transmission cable 33 can travel across the first through hole 314 and then be connected with the directional coupler circuit. To help wiring of an antenna (not shown), an axis of the through hole 314 is angled relative to the longitudinal direction of the cavity 31. Preferably, the angle ranges from 30° to 150°, which can be freely selected by person of the art according to welding direction of the transmission cable 33 for facilitating layout of the transmission cable 33. The enclosing walls, on which no wiring slots are formed, of the cavity 31, are provided with operation holes 312 corresponding to the first through holes 314 respectively for realizing electrical connection between the inner conductor of the transmission cable 33 and input or output port of the coupler circuit 32. A number of holding grooves 313 may be defined in an inner wall of each of a pair of opposed enclosing walls of the cavity 31 for holding the base plate of the coupler circuit 32 in place. The coupler circuit 32 is a single or double-sided printed circuit with function of coupling. This circuit 32 also includes a directional coupler circuit unit 32 printed on the base plate. During assembly, the base plate, on which the directional coupler circuit unit 32 is carried, is inserted into the holding grooves 313 of the cavity 31 and is welded to the outer and inner conductors of the transmission cable 33 respectively.

Figure 8:
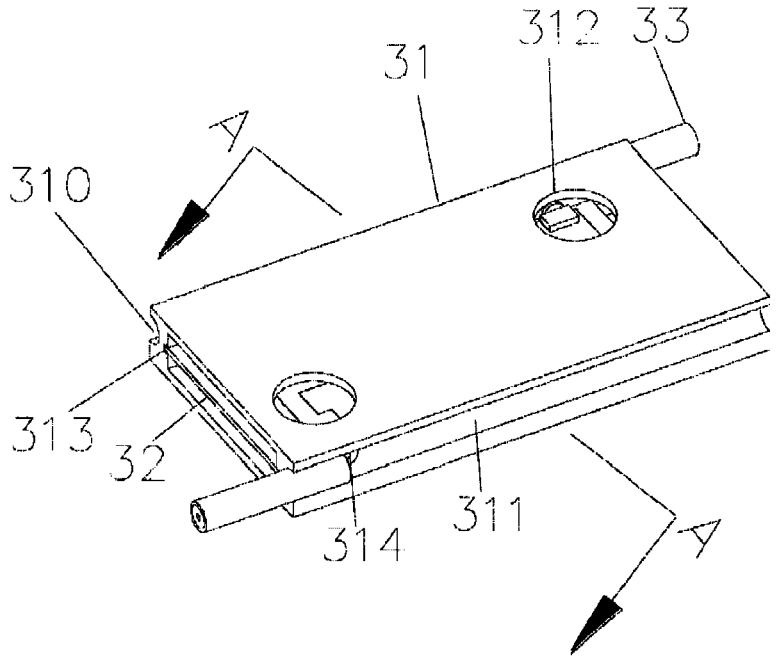
FIG. 8 shows a perspective view of a filter of a third embodiment according to the present invention.
Figure 9:
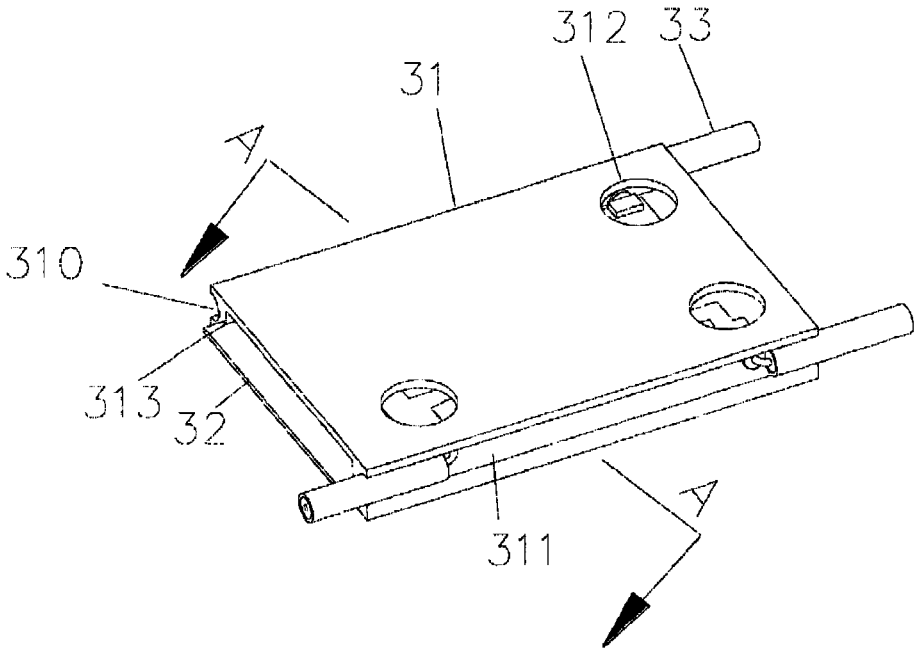
FIG. 9 shows a perspective view of a diplexer of a third embodiment according to the present invention.

Furthermore, please refer to FIGS. 8-9. In case the circuit unit 320 of the microwave network circuit 32 is a filter circuit or diplexer circuit, a corresponding filter or diplexer will be formed. When the microwave component is a filter, according to demand, an external operation element such as tuning screw may be disposed at an opened end of the cavity, as will be understood by person of the art for tuning the filter.

Fourth Embodiment

Figure 10:
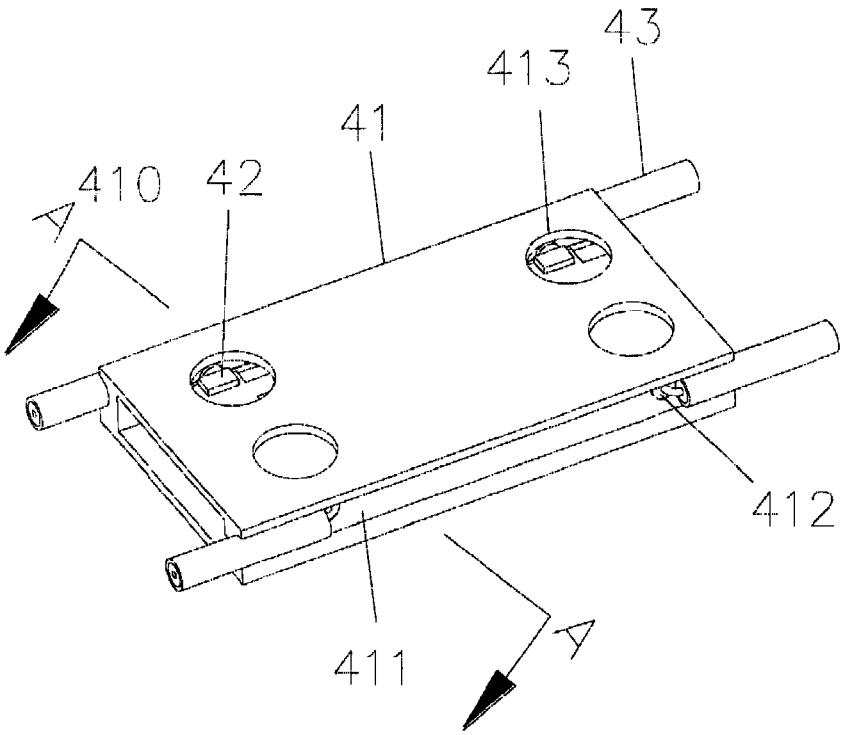
FIG. 10 shows a perspective view of a power divider of a fourth embodiment according to the present invention.
Figure 11:
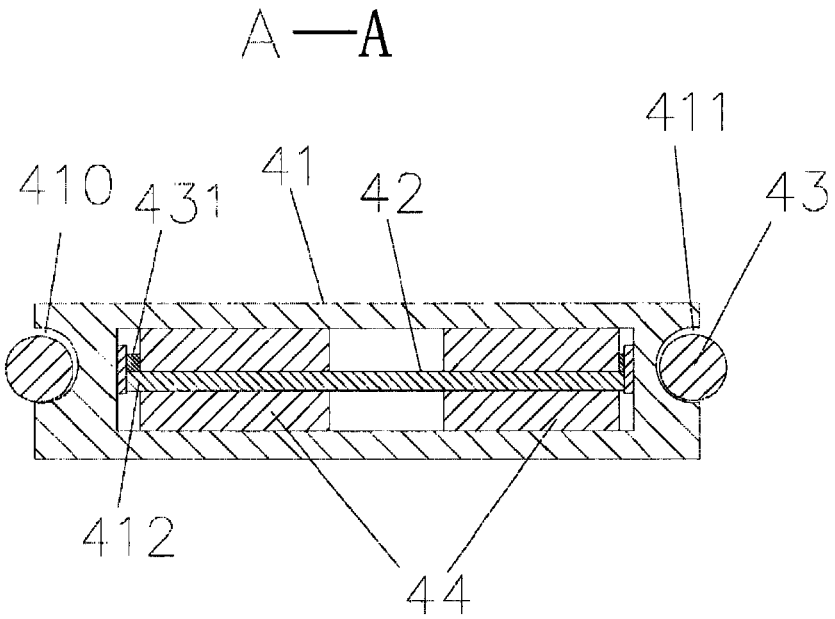
FIG. 11 shows a cross-sectional view of the power divider in FIG. 10 along line A-A.

Please refer to FIGS. 10-11. The microwave component of cavity type of the present invention is a power divider with four ports, three of which are output ports, while the rest one is input port. The power divider includes a cavity 41, a power divider circuit 42, a transmission cable 43, and an insulated structural component 44.

The cavity 41 is integrally formed by extrusion or die-casting. A chamber (not labeled) is defined inside the cavity 41 and extends along the longitudinal direction thereof. Two enclosing walls of the cavity 41 are provided with a first wiring slot 410 and a second wiring slot 411 respectively for welding the transmission cable 33 and its outer conductor. A number of first though holes 412, which extend across the enclosing walls of the cavity, are defined in each of the first wiring slot 410 and second wiring slot 411. An inner conductor of the transmission cable 43 can travel across the first through hole 412. To help wiring of an antenna, an axis of the first through hole 412 is angled relative to the longitudinal direction of the cavity 41. Preferably, the angle ranges from 30° to 150°, which can be freely selected by person of the art according to the welding direction of the transmission cable 43 for facilitating layout of the transmission cable 43.

Corresponding to the through hole 412, an operation hole 413 is defined at the top of the cavity 41 so that the inner conductor of the transmission cable 43 will be readily electrically connected with an input port or output port of the power divider circuit 42. In this embodiment, the microwave network circuit 42 is a power divider circuit 42 constructed of metal conductor and based on principle of power divider circuit. This circuit 42 is held inside the cavity 41 by several insulated structural components 44.

In a summary, according to the present invention, as wiring slots are defined in the enclosing walls of the cavity of the microwave component, complicated components such as transmission cable adapter and cover of the microwave component are no longer required, thus making it easier for integrally forming the cavity and also bringing size reduction.

In the present invention, the microwave network circuit of the microwave component of cavity type may employ PCB or metal conductor structure according to need, which having a great flexibility.

Moreover, as no fastening realized by screw is utilized in the microwave component of cavity type of the present invention, cost is decreased, batch production is easy to run, and inter-modulation products caused by fasteners such as screws are eliminated.

Though various embodiments of the present invention have been illustrated above, a person of ordinary skill in the art will understand that, variations and improvements made upon the illustrative embodiments fall within the scope of the invention, and the scope of the invention is only limited by the accompanying claims and their equivalents.

The invention claimed is:

1. A microwave component of cavity type, comprising:

an integral cavity body; and a microwave network circuit arranged within the cavity body;

wherein the cavity body is formed by extrusion and includes multiple enclosing walls and one or more chambers defined by said multiple enclosing walls;

wherein the chamber is configured to accommodate the microwave network circuit therein; and wherein a wiring slot is defined in at least one of the enclosing walls, and at least one first through hole extended through the chamber is provided on each wiring slot;

wherein a number of wiring slots are defined in a same enclosing wall; and wherein each wiring slot is provided with said first through hole for arranging a transmission cable along a respective wiring slot and permitting the transmission cable passing through the first through hole to connect with the microwave network circuit so as to form a connection port.

2. The microwave component of cavity type as recited in claim 1, wherein the first hole is arranged such that an axis of the first through hole is inclined with respect to a longitudinal direction of the microwave component.

3. The microwave component of cavity type as recited in claim 2, wherein the above inclination angle in the range of 30° to 150°.

4. The microwave component of cavity type as recited in claim 1, wherein each enclosing wall, on which wiring slot is not provided, of the cavity, is provided with an operation hole corresponding to a respective first through hole.

5. The microwave component of cavity type as recited in claim 1, wherein each said wiring slot is set in a layered or segmented manner.

6. The microwave component of cavity type as recited in claim 1, wherein two opposite or adjacent enclosing walls are provided with the wiring slots respectively; and each wiring slot is provided with said first through hole for arranging a transmission cable along a respective wiring slot and permitting the transmission cable passing through the first through hole to connect with the microwave network circuit so as to form a connection port.

7. The microwave component of cavity type as recited in claim 1, wherein the wiring slot is connected and secured with an outer conductor of the cable by solder; and an inner conductor of the cable is allowed to pass through the first through hole and extend into the cavity to connect with the microwave network circuit.

8. The microwave component of cavity type as recited in claim 1, wherein at least one of two end surfaces along the longitudinal direction of the microwave component of cavity type is not provided with enclosing walls such that an opening is predefined therein through which the microwave network circuit is able to connect to an external operation element.

9. The microwave component of cavity type as recited in claim 1, wherein a holding groove is defined in each of a pair of opposed enclosing walls of the cavity along a longitudinal direction for holding a base plate of the microwave network circuit in place.

10. The microwave component of cavity type as recited in claim 1, wherein an embossment is provided in an inner wall of each of a pair of opposite enclosing walls of the cavity along a longitudinal direction for separating the cavity.

11. The microwave component of cavity type as recited in claim 1, wherein the base plate of the microwave network circuit is provided with a metal welding piece at two sides thereof and said metal welding piece is welded inside the cavity.

12. The microwave component of cavity type as recited in claim 1, wherein the microwave network circuit is a phase shifter circuit, filter circuit, power divider circuit, coupler circuit, diplexer circuit or combiner circuit.

* * * * *